US007971318B2

(12) United States Patent
Kim et al.

(10) Patent No.: US 7,971,318 B2
(45) Date of Patent: Jul. 5, 2011

(54) HINGE ASSEMBLY AND MOBILE TERMINAL HAVING THE SAME

(75) Inventors: Seong-Geun Kim, Suwon-si (KR); Sung-Tai Jung, Suwon-si (KR); Ga-Young An, Busan (KR); Yun-Mo Kang, Seoul (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 390 days.

(21) Appl. No.: 12/320,741

(22) Filed: Feb. 3, 2009

(65) Prior Publication Data

US 2009/0255090 A1 Oct. 15, 2009

(30) Foreign Application Priority Data

Apr. 10, 2008 (KR) ..... 10-2008-0033069
May 14, 2008 (KR) ..... 10-2008-0044627

(51) Int. Cl.
*E05D 11/10* (2006.01)

(52) U.S. Cl. ..... 16/330; 16/303; 16/54; 16/50

(58) Field of Classification Search ..... 16/367, 16/386, 338–340, 330, 303, 380, 54, 50; 361/679.06, 679.27, 679.28, 679.11, 679.12, 361/679.13; 379/433.12, 433.13; 455/575.1, 455/575.4, 575.8, 550.1, 90.3; 348/373, 348/333.06, 794; 188/290–296, 322.5, 316, 188/317

See application file for complete search history.

(56) References Cited

U.S. PATENT DOCUMENTS 5,636,275 A * 6/1997 Takagi et al. ..... 379/433.13
6,195,431 B1 * 2/2001 Middleton ..... 379/433.13
6,233,785 B1 * 5/2001 Tanahashi ..... 16/337
6,913,125 B2 * 7/2005 Hayashi ..... 188/290
7,117,562 B2 * 10/2006 Zuo et al. ..... 16/303
7,401,381 B2 * 7/2008 Konja et al. ..... 16/285
7,416,063 B2 * 8/2008 Araki et al. ..... 188/296
2004/0181909 A1 * 9/2004 Kawamoto ..... 16/330
2005/0193523 A1 * 9/2005 Nam et al. ..... 16/330
2006/0085947 A1 * 4/2006 Ge et al. ..... 16/303
2006/0096064 A1 * 5/2006 Ma et al. ..... 16/303
2007/0094843 A1 * 5/2007 Yang ..... 16/330
2007/0294859 A1 * 12/2007 Hsu et al. ..... 16/330

FOREIGN PATENT DOCUMENTS

JP 2005-23950 1/2005
KR 10-2007-0032457 3/2007

OTHER PUBLICATIONS

Korean Office Action issued on Nov. 25, 2010 in corresponding Korean Patent Application 10-2008-0044627.
Korean Office Action issued on Nov. 25, 2010 in corresponding Korean Patent Application 10-2008-0033069.

* cited by examiner

*Primary Examiner* — Chuck Y. Mah

(57) ABSTRACT

A hinge assembly and a mobile terminal are disclosed. The hinge assembly can include: a torsion spring; a shaft, which penetrates through the torsion spring; a bushing, coupled to one end of the torsion spring and to one side of the shaft; a holder, which is coupled to the other end of the torsion spring, and which the shaft penetrates through; a sliding cam, which is coupled to the other side of the shaft, and which may move in linkage with the shaft; a fixed cam, which engages the sliding cam; a compression spring, which is positioned between the holder and the sliding cam, and which may place the sliding cam in close contact with the fixed cam; and a housing coupled to the holder and the fixed cam. Thus, the mobile terminal can be unfolded automatically using just a few number of parts without requiring energy consumption.

36 Claims, 13 Drawing Sheets

HINGE ASSEMBLY AND MOBILE TERMINAL HAVING THE SAME

CROSS-REFERENCE TO RELATED APPLICATIONS

This application claims the benefit of Korean Patent Applications No. 10-2008-0033069 and No. 10-2008-0044627 filed with the Korean Intellectual Property Office on Apr. 10, 2008 and May 14, 2008, respectively. The disclosures of these applications are incorporated herein by reference in their entirety.

BACKGROUND

1. Technical Field

The present invention relates to a hinge assembly and a mobile terminal equipped with the hinge assembly.

2. Description of the Related Art

The structure of a manual hinge assembly, used in a conventional folder type mobile terminal, may employ a cam and a spring such that the mobile terminal moves to an unfolded configuration if the mobile terminal is at an angle greater than a threshold value and such that the mobile terminal moves to a folded configuration if the mobile terminal is at an angle smaller than the threshold value.

Due to the use of only the cam and spring, this conventional hinge assembly may not move in smooth, soft motions, but may rather cause an impact on the mobile terminal when folding and unfolding.

In addition to the hinge assembly described above, a structure may also be used in which a motor is inserted in the hinge assembly for automatic folding and/or unfolding. This structure, however, may require a degree of electrical energy consumption due to the use of the motor.

SUMMARY

An aspect of the invention is to provide a hinge assembly and a mobile terminal equipped with the hinge assembly that can automatically unfold the mobile terminal using a few number of parts.

One aspect of the invention provides a hinge assembly that includes: a torsion spring; a shaft, which penetrates through the torsion spring; a bushing, coupled to one end of the torsion spring and to one side of the shaft; a holder, which is coupled to the other end of the torsion spring, and which the shaft penetrates through; a sliding cam, which is coupled to the other side of the shaft, and which may move in linkage with the shaft; a fixed cam, which engages the sliding cam; a compression spring, which is positioned between the holder and the sliding cam, and which may place the sliding cam in close contact with the fixed cam; and a housing coupled to the holder and the fixed cam.

Here, the cross section of the other side of the shaft can be shaped as a D-cut, and the cross section of a coupling portion on the sliding cam can be shaped in correspondence with the cross section of the other side of the shaft.

An indentation can be formed in the holder, and the compression spring can be inserted in the indentation and supported by the indentation, in order that the compression spring may elastically press the sliding cam and keep the sliding cam in close contact with the fixed cam.

The housing can cover the torsion spring, the shaft, the holder, the sliding cam, the fixed cam, and the compression spring.

Another aspect of the invention provides a mobile terminal that includes: a base unit, a folder unit rotatably coupled to the base unit, and a hinge assembly interposed between the base unit and the folder unit to rotatably couple the base unit and the folder unit. Here, the hinge assembly includes a torsion spring; a shaft, which penetrates through the torsion spring; a bushing, coupled to one end of the torsion spring and to one side of the shaft; a holder, which is coupled to the other end of the torsion spring, and which the shaft penetrates through; a sliding cam, which is coupled to the other side of the shaft, and which may move in linkage with the shaft; a fixed cam, which engages the sliding cam; a compression spring, which is positioned between the holder and the sliding cam, and which may place the sliding cam in close contact with the fixed cam; and a housing coupled to the holder and the fixed cam.

Here, the cross section of the other side of the shaft can be shaped as a D-cut, and the cross section of a coupling portion on the sliding cam can be shaped in correspondence with the cross section of the other side of the shaft.

An indentation can be formed in the holder, and the compression spring can be inserted in the indentation and supported by the indentation, in order that the compression spring may elastically press the sliding cam and keep the sliding cam in close contact with the fixed cam.

The housing can cover the torsion spring, the shaft, the holder, the sliding cam, the fixed cam, and the compression spring.

The base unit of the mobile terminal can be coupled to either one of the housing and the bushing, while the folder unit can be coupled to the other of the housing and the bushing.

Still another aspect of the invention provides a hinge assembly that includes: a torsion spring; a shaft, which penetrates through the torsion spring; a bushing, coupled to one end of the torsion spring and to one side of the shaft; a holder, which is coupled to the other end of the torsion spring, and which the shaft penetrates through; a sliding cam, which is coupled to the other side of the shaft, and which may move in linkage with the shaft; a fixed cam, which engages the sliding cam; a compression spring, which is positioned between the holder and the sliding cam, and which may place the sliding cam in close contact with the fixed cam; a housing coupled to the holder and the fixed cam; and a damper, which is coupled to the shaft, and which is configured to dampen a rotation speed of the shaft.

The damper may be configured to dampen the rotation speed of the shaft at certain angles from among the range of possible rotation angles of the shaft.

The damper can include: a case, which may be coupled to the housing, and through which the shaft may be inserted; a core, which may be rotatably held inside the case, and which may move in linkage with the shaft; and a viscous fluid, which may be interposed between the case and the core.

The core can be configured to move in linkage with the shaft at certain angles from among the range of possible rotation angles of the shaft.

The core may be shaped as a hollow tube, allowing the shaft to be inserted and rotated inside the core. A detent protrusion may be formed on an inner wall of the core, allowing the core to move in linkage with the shaft at certain angles from among the range of possible rotation angles of the shaft.

On the perimeter of the core, a blade can be formed to increase friction with the viscous fluid.

Also, a protruding portion can be formed on an inner wall of the case, to inhibit the flow of the viscous fluid or limit the rotation angle of the core.

The case may include: a case body, which may hold the core and the viscous fluid; and a case lid, through which the shaft may penetrate, and which may cover the core and the case in such a way that the viscous fluid is sealed.

The case lid can be placed in close contact with one surface of the core and one surface of the case body. The case lid can surround a perimeter of one side of the core in close contact and can be positioned in close contact with one surface of the case body.

The cross section of the other side of the shaft can be shaped as a D-cut. A coupling portion can be formed on the sliding cam that couples with the other side of the shaft, where the cross section of a coupling portion on the sliding cam can be shaped in correspondence with the cross section of the other side of the shaft.

An indentation can be formed in the holder in which the compression spring may be inserted.

The housing can cover the torsion spring, the shaft, the holder, the sliding cam, the fixed cam, the compression spring, and the damper.

Yet another aspect of the invention provides a mobile terminal that includes: a base unit, a folder unit rotatably coupled to the base unit, and a hinge assembly interposed between the base unit and the folder unit to rotatably couple the base unit and the folder unit. Here, the hinge assembly includes a torsion spring; a shaft, which penetrates through the torsion spring; a bushing, coupled to one end of the torsion spring and to one side of the shaft; a holder, which is coupled to the other end of the torsion spring, and which the shaft penetrates through; a sliding cam, which is coupled to the other side of the shaft, and which may move in linkage with the shaft; a fixed cam, which engages the sliding cam; a compression spring, which is positioned between the holder and the sliding cam, and which may place the sliding cam in close contact with the fixed cam; a housing coupled to the holder and the fixed cam; and a damper, which is coupled to the shaft, and which is configured to dampen a rotation speed of the shaft.

The damper may be configured to dampen the rotation speed of the shaft at certain angles from among the range of possible rotation angles of the shaft.

The damper can include: a case, which may be coupled to the housing, and through which the shaft may be inserted; a core, which may be rotatably held inside the case, and which may move in linkage with the shaft; and a viscous fluid, which may be interposed between the case and the core.

The core can be configured to move in linkage with the shaft at certain angles from among the range of possible rotation angles of the shaft.

The core may be shaped as a hollow tube, allowing the shaft to be inserted and rotated inside the core. A detent protrusion may be formed on an inner wall of the core, allowing the core to move in linkage with the shaft at certain angles from among the range of possible rotation angles of the shaft.

Also, on the perimeter of the core, a blade can be formed to increase friction with the viscous fluid.

A protruding portion can be formed on an inner wall of the case, to inhibit the flow of the viscous fluid or limit the rotation angle of the core.

The case may include: a case body, which may hold the core and the viscous fluid; and a case lid, through which the shaft may penetrate, and which may cover the core and the case in such a way that the viscous fluid is sealed.

The case lid can be placed in close contact with one surface of the core and one surface of the case body. The case lid can surround a perimeter of one side of the core in close contact and can be positioned in close contact with one surface of the case body.

The cross section of the other side of the shaft can be shaped as a D-cut. A coupling portion can be formed on the sliding cam that couples with the other side of the shaft, where the cross section of a coupling portion on the sliding cam can be shaped in correspondence with the cross section of the other side of the shaft.

An indentation can be formed in the holder in which the compression spring may be inserted.

The housing can cover the torsion spring, the shaft, the holder, the sliding cam, the fixed cam, the compression spring, and the damper.

The base unit of the mobile terminal can be coupled to either one of the housing and the bushing, while the folder unit can be coupled to the other of the housing and the bushing.

Additional aspects and advantages of the present invention will be set forth in part in the description which follows, and in part will be obvious from the description, or may be learned by practice of the invention.

DETAILED DESCRIPTION

Figure 1:
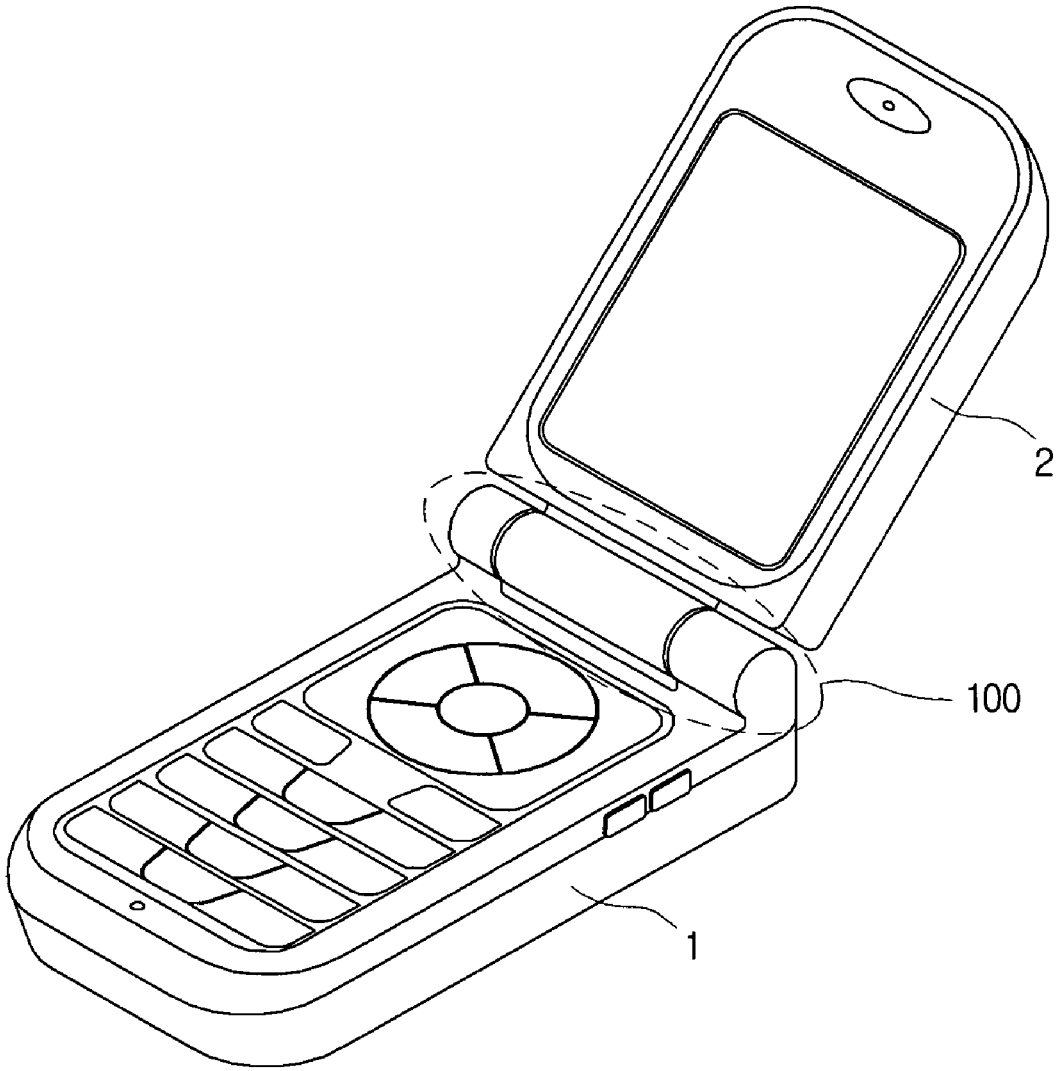
FIG. 1 is a perspective view of a mobile terminal having a hinge assembly according to a first disclosed embodiment of the invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. In the description of the present invention, certain detailed explanations of related art are omitted when it is deemed that they may unnecessarily obscure the essence of the invention.

The terms used in the present specification are merely used to describe particular embodiments, and are not intended to limit the present invention. An expression used in the singular encompasses the expression of the plural, unless it has a clearly different meaning in the context. In the present specification, it is to be understood that the terms such as "including" or "having," etc., are intended to indicate the existence of the features, numbers, steps, actions, elements, parts, or combinations thereof disclosed in the specification, and are not intended to preclude the possibility that one or more other features, numbers, steps, actions, elements, parts, or combinations thereof may exist or may be added.

The hinge assembly and mobile terminal equipped with a hinge assembly according to certain embodiments of the invention will be described below in more detail with reference to the accompanying drawings. Those elements that are the same or are in correspondence are rendered the same reference numeral regardless of the figure number, and redundant explanations are omitted.

Figure 2:
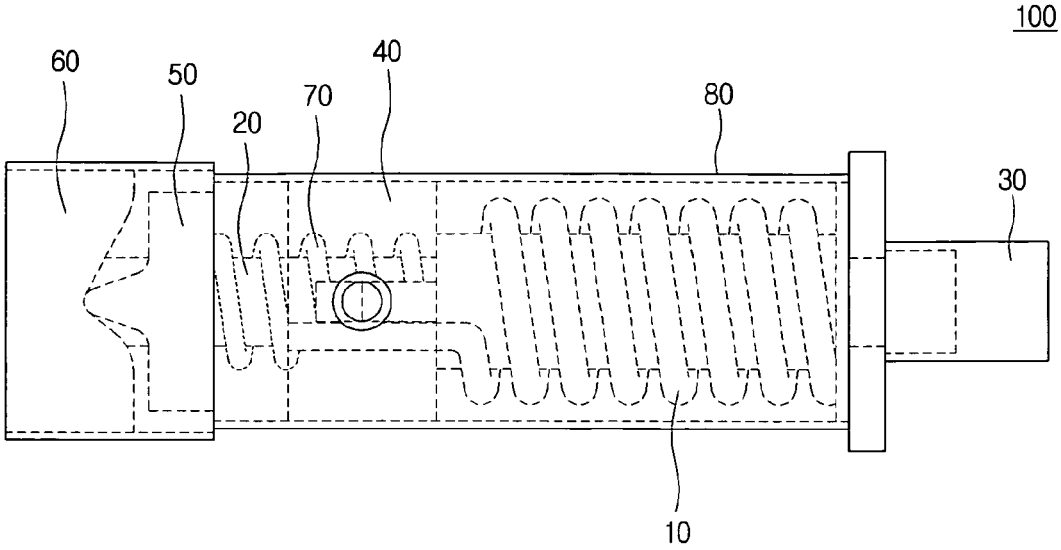
FIG. 2 is a front view of a hinge assembly according to the first disclosed embodiment of the invention.
Figure 3:
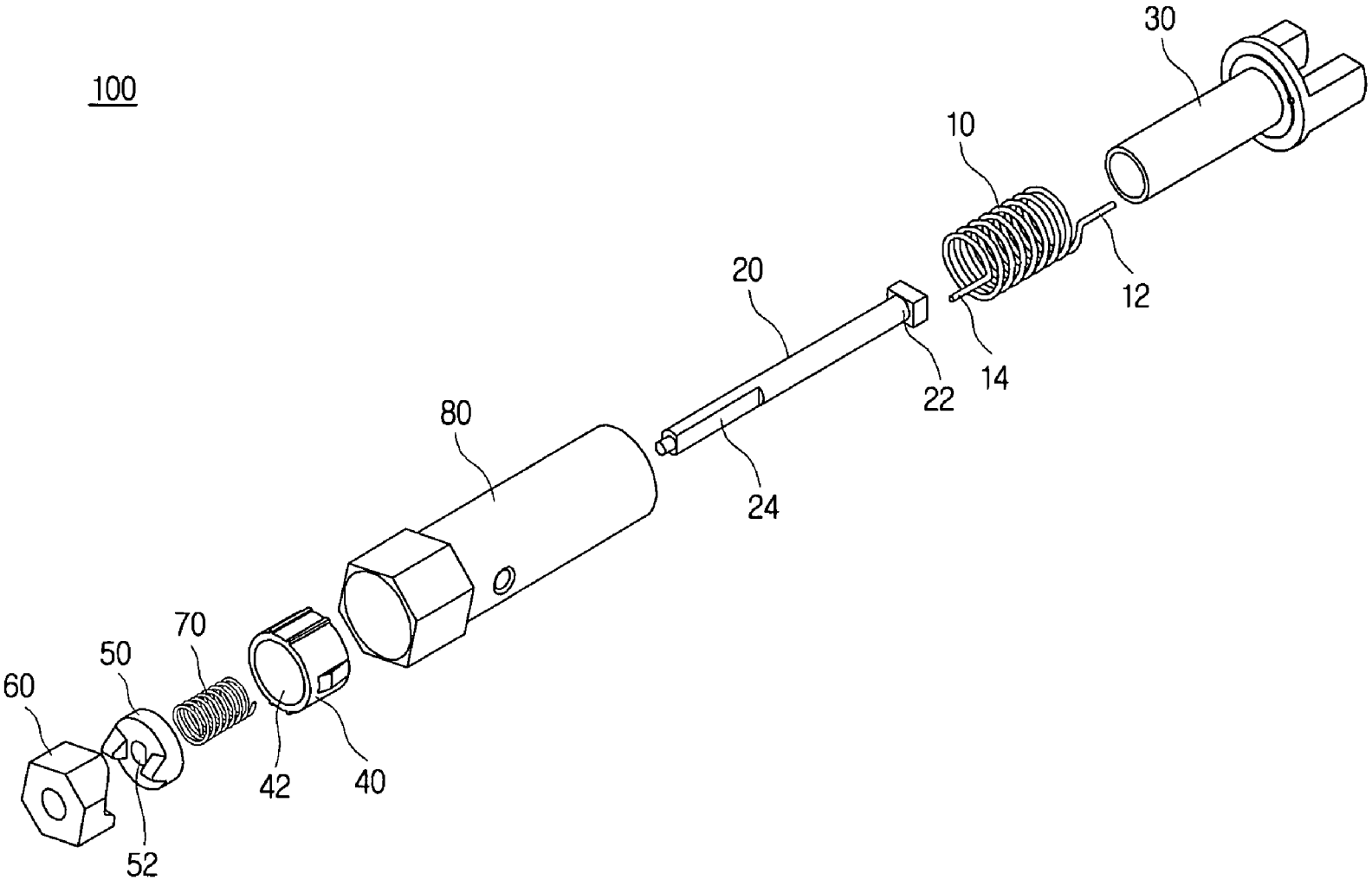
FIG. 3 is an exploded perspective view of a hinge assembly according to the first disclosed embodiment of the invention.

FIG. 1 is a perspective view of a mobile terminal having a hinge assembly according to a first disclosed embodiment of the invention, FIG. 2 is a front view of a hinge assembly according to the first disclosed embodiment of the invention, and FIG. 3 is an exploded perspective view of a hinge assembly according to the first disclosed embodiment of the invention. In FIGS. 1 to 3, there are illustrated a base unit 1, a folder unit 2, a torsion spring 10, one end 12 of the torsion spring, the other end 14 of the torsion spring, a shaft 20, one side 22 of the shaft, the other side 24 of the shaft, a bushing 30, a holder 40, an indentation 42, a sliding cam 50, a coupling portion 52 of the sliding cam, a fixed cam 60, a compression spring 70, a housing 80, and a hinge assembly 100.

The first disclosed embodiment of the invention provides a hinge assembly 100 and a mobile terminal equipped with the hinge assembly. The hinge assembly 100 can include a torsion spring 10, which may provide the force for unfolding the folder type mobile terminal; a shaft 20, which may penetrate the internal space of the torsion spring; a bushing 30, which may be coupled to one end 12 of the torsion spring and one side 22 of the shaft; a holder 40, which may be coupled to the other end 14 of the torsion spring, and through which the shaft may penetrate; a sliding cam 50, which may be coupled to the other side 24 of the shaft to move in linkage with the shaft; a fixed cam 60, which may face and touch the sliding cam; a compression spring 70, which may be interposed between the holder and the sliding cam; and a housing 80, which may be coupled to the holder and the fixed cam.

According to this embodiment, the hinge assembly 100 can be interposed between a base unit 1 and a folder unit 2 of a mobile terminal to rotatably couple the base unit 1 with the folder unit 2, as illustrated FIG. 1. The torsion spring 10 of the hinge assembly may provide an elastic rotation force to unfold the folder type mobile terminal from a folded state.

When the base unit 1 and the folder unit 2 are in a folded state, the torsion spring 10 may retain elastic torsion energy, which may be used to unfold the mobile terminal. A mobile terminal having a hinge assembly 100 according to an embodiment of the invention may be kept folded by a magnetic attaching member or detent member that applies a force greater than the elastic force of the torsion spring. Then, when the force of the magnetic attaching member or detent member keeping the base unit 1 and the folder unit 2 folded is removed, the mobile terminal may be automatically unfolded by the torsion spring.

That is, in a mobile terminal equipped with a hinge assembly 100 according to the first disclosed embodiment of the invention, the base unit and folder unit may, from a folded state, be automatically unfolded by the elastic force of the torsion spring 10.

The torsion spring 10 can have a helical shape, as illustrated in FIGS. 2 and 3, and can be an elastic member that asserts a restoring force against twisting. The hinge assembly 100 may provide rotation in a particular direction using the elastic restoring force of the torsion spring, at which the base unit 1 and the folder unit 2 of the mobile terminal coupled by the hinge assembly may be automatically unfolded from a folded state.

The shaft 20 can penetrate through the torsion spring 10, and one side of the shaft 20 can be coupled to the bushing 30 such that the shaft 20 may move in linkage with the bushing 30. The shaft may correspond to the axis about which the hinge assembly 100 provides rotation. The shaft penetrating the torsion spring can also penetrate the holder 40 and can be coupled with the sliding cam 50 and the bushing 30 such that the shaft may move in linkage with the sliding cam 50 and the busing 30.

One end 12 of the torsion spring 10 can be coupled to the bushing 30, which may be coupled to one side 22 of the shaft 20. That is, with one end of the torsion spring coupled to the bushing, the torsion spring can provide a torsional elastic force to the bushing and the shaft. As the torsion spring, which may have one end coupled to and supported by the bushing, is twisted beyond its basic shape, the torsion spring may provide a torsional elastic force (torque).

Also, one side 22 of the shaft can be coupled to the bushing 30. According to this particular embodiment, the shaft 20 and the bushing can be coupled to each other for linked movement.

The shaft 20 can also penetrate the holder 40, and the other end 14 of the torsion spring 10 can be coupled to the shaft 20. Although the shaft may penetrate the holder, it may not move in linkage with the holder. That is, due to the torsion spring that has one end coupled to the bushing 30 and the other end coupled to the holder 40, the bushing and the shaft can be made to rotate in relative movement to the holder.

The sliding cam 50 can be coupled to the other side 24 of the shaft penetrating the holder 40. The sliding cam 50 can be coupled to the other side of the shaft, in order that the sliding cam may rotate in linkage with the shaft 20. The other side 24 of the shaft that is inserted through the coupling portion 52 of the sliding cam can have a cross section shaped as a D-cut, while the cross section of the coupling portion 52 of the sliding cam can be shaped in a D-cut in correspondence with the cross section of the other side 24 of the shaft. In this way, the sliding cam 50 and the shaft 20 can be made to move in linkage.

The fixed cam 60 can be positioned facing and touching the sliding cam 50. That is, the fixed cam can engage the sliding cam. The fixed cam can be placed in close contact with the sliding cam, which may move in linkage with the shaft 20. Thus, as described later in more detail, the fixed cam may control the rotation speed of the sliding cam and may thereby dampen the rotation of the shaft and the bushing.

The compression spring 70 can be positioned between the holder 40 and the sliding cam 50. An indentation 42 can be formed in the holder in which a portion of the compression spring may be inserted, so that the compression spring may be supported by the indentation of the holder to elastically push the sliding cam. In this way, the sliding cam can be placed in close contact with the fixed cam 60. As the sliding cam is put in close contact with the fixed cam, the sliding cam and the fixed cam may engage each other with greater reliability.

The housing 80 can be coupled with the fixed cam 60 and the holder 40, which may not move in linkage with the shaft 20. The housing can secure the fixed cam 60 and the holder inside, and can hold the sliding cam 50, shaft 20, compression spring 70, and torsion spring 10. In other words, according to this embodiment, the housing may cover the torsion spring, shaft, holder, sliding cam, fixed cam, and compression spring 70. That is, the fixed cam and the holder may be covered secured to the housing 80, while the sliding cam, the shaft, and the torsion spring may be covered inside the housing in a manner that allows rotation.

According to this particular embodiment, the bushing 30 coupled to the one side 22 of the shaft may be exposed outside the housing 80.

The hinge assembly 100 according to this embodiment can be structured such that the sliding cam 50, shaft, and bushing 30 may be rotated by the elastic force of the torsion spring 10 in an opposite direction to the housing 80, fixed cam 60, and holder 40.

As set forth above, a hinge assembly 100 according to the first disclosed embodiment of the invention can be employed in coupling the base unit 1 and the folder unit 2 of a mobile terminal, to provide a mobile terminal that can be automatically unfolded without using a motor.

As illustrated in FIG. 1, a hinge 100 structure according to this embodiment can be applied to a mobile terminal that includes a base unit 1, which may contain a board mounted with various electronic components, and which may include a keypad, etc.; a folder unit 2, which may be coupled to the base unit 1 in a manner that allows folding, and which may be unfolded by rotation; and a hinge assembly, which may be interposed between the base unit 1 and the folder unit 2 to rotatably couple the base unit 1 and folder unit 2 to each other.

A mobile terminal apparatus equipped with a hinge assembly 100 according to the first disclosed embodiment of the invention may thus be automatically unfolded without using a motor that requires electrical energy. Moreover, the hinge assembly based on this embodiment may provide a longer life span than does a hinge structure that requires a motor.

When the mobile terminal is folded, the torsion spring 10 may be torsionally deformed and may retain a torsional elastic restoring force in a direction that unfolds the base unit 1 and folder unit 2 of the mobile terminal. As the force of the magnetic attaching member or detent member keeping the base unit 1 and the folder unit 2 folded is removed, the bushing 30 and the housing 80 of the hinge assembly may rotate in opposite directions. In this way, the base unit 1 and the folder unit 2 each coupled to one and the other of the bushing and the housing may be unfolded.

According to this embodiment, the sliding cam 50, shaft 20, and bushing 30 can be rotated by the torsional elastic force of the torsion spring 10 in an opposite direction to the holder 40, fixed cam 60, and housing 80. Therefore, with the base unit 1 coupled to the housing, for example, and the folder unit 2 coupled to the bushing, the mobile terminal may be automatically unfolded. In other words, the base unit 1 and the folder unit 2 can be coupled to elements of the hinge assembly 100 that are rotated by the torsion spring 10 in different directions, to rotate together with the rotation of the hinge assembly.

Of course, according to the internal structure by which the base unit 1 and the folder unit 2 are coupled, the base unit 1 may be coupled to the bushing 30, while the folder unit 2 may be coupled to the housing 80.

The fixed cam 60, which may be coupled to the housing, can engage the sliding cam 50, which may be in linkage with the shaft 20. A tapering protrusion can be formed on the sliding cam, while a tapering depression can be formed in the fixed cam, so that the sliding cam may mate with the fixed cam. The shapes of the sliding cam and fixed cam described above may vary according to the demands of the user. With the fixed cam facing and maintaining contact with the sliding cam, which may undergo a relative rotating motion, the fixed cam may provide a damping force to the rotation of the sliding cam. The amount of damping force applied to the rotating motion of the hinge assembly can be adjusted according to the shape and structure of the interlocking fixed cam and sliding cam.

The fixed cam 60 and the sliding cam 50 may dampen the rotating speed of the elements of the hinge assembly 100. The rotation speed of the bushing 30 relative to the housing 80 may reach its maximum when the restoring force of the torsion spring 10 becomes 0, but this rotating speed can be dampened by the damping function provided by the sliding cam engaging the fixed cam.

The sliding cam 50, the shaft 20 moving in linkage with the sliding cam, and the bushing 30 coupled to the shaft can be rotated by the torsion spring 10 relative to the housing 80, where the rotation speed can be dampened by the fixed cam 60.

According to the first disclosed embodiment of the invention, when the restoring force of the torsion spring 10 unfolds the base unit and the folder unit, which may each be coupled to one and the other of the bushing 30 and the housing 80, the damping function of the fixed cam 60 and the sliding cam 50 may be implemented. Therefore, the mobile terminal can be unfolded smoothly, without receiving an impact at the maximum unfolding position.

In order to smoothly adjust the speed by which the mobile terminal may be unfolded, a reliable mating may be provided between the fixed cam 60 and the sliding cam 50. According to the first disclosed embodiment of the invention, the compression spring 70 interposed between the holder 40 and the sliding cam can be supported by the holder to continuously apply an elastic force onto the sliding cam. Thus, the sliding cam can be placed in close contact with the fixed cam 60 by the compression spring continuously, to thereby implement the hinge assembly 100 with a reliable damping function.

A hinge assembly 100 based on this embodiment can thus be utilized to automatically unfold a motor terminal, without using a motor that requires electrical energy consumption, and to implement a smooth unfolding motion for the mobile terminal.

A description will now be provided, with reference to FIG. 4 through FIG. 8, for a hinge assembly and a mobile terminal having the hinge assembly according to a second disclosed embodiment of the invention.

Figure 4:
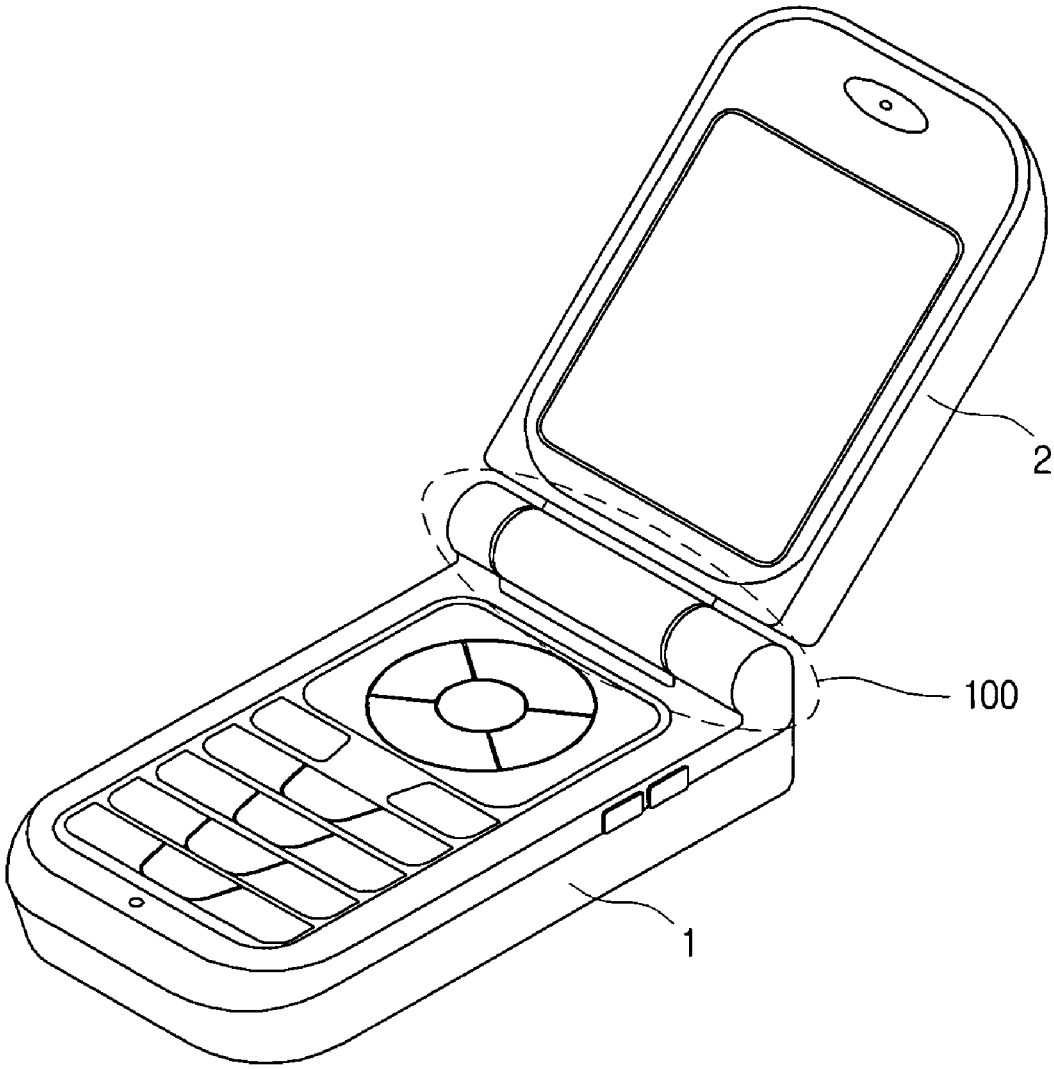
FIG. 4 is a perspective view of a mobile terminal having a hinge assembly according to a second disclosed embodiment of the invention.
Figure 5:
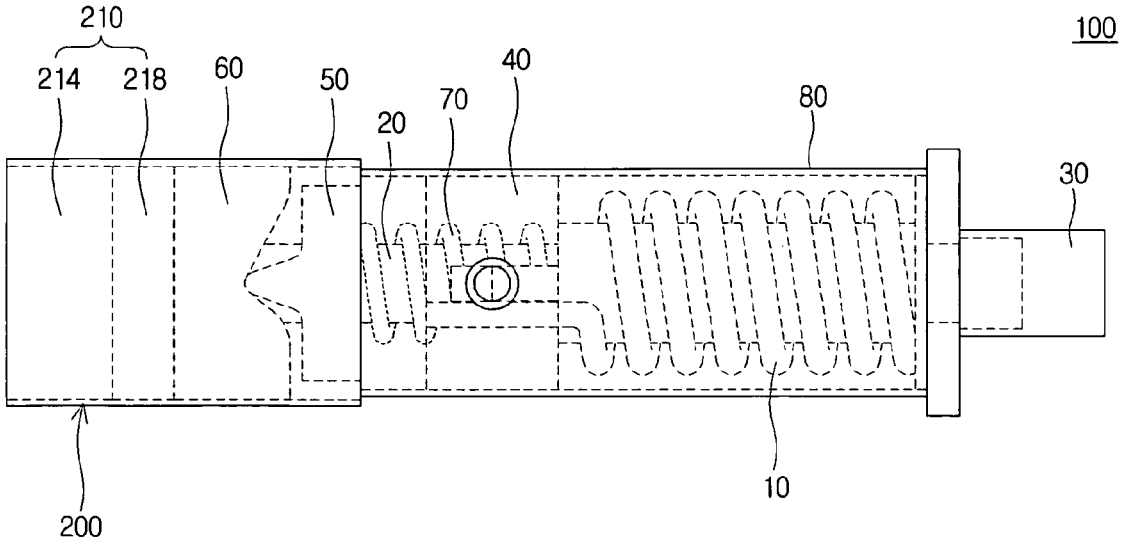
FIG. 5 is a front view of a hinge assembly according to the second disclosed embodiment of the invention.
Figure 6:
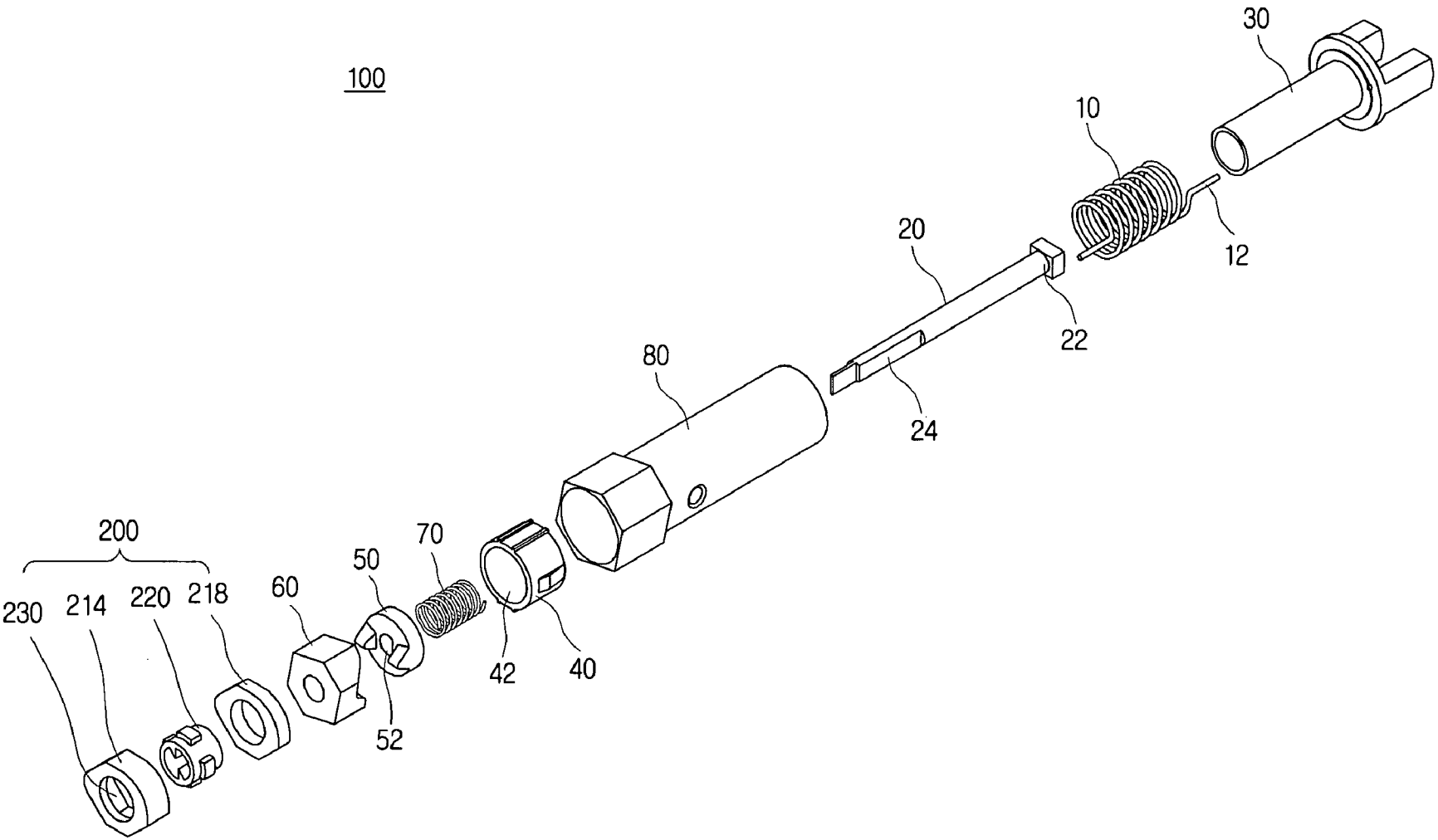
FIG. 6 is an exploded perspective view of a hinge assembly according to the second disclosed embodiment of the invention.

FIG. 4 is a perspective view of a mobile terminal having a hinge assembly according to the second disclosed embodiment of the invention, FIG. 5 is a front view of a hinge assembly according to the second disclosed embodiment of the invention, and FIG. 6 is an exploded perspective view of a hinge assembly according to the second disclosed embodiment of the invention. In FIGS. 4 to 6, there are illustrated a base unit 1, a folder unit 2, a torsion spring 10, one end 12 of the torsion spring, the other end 14 of the torsion spring, a shaft 20, one side 22 of the shaft, the other side 24 of the shaft, a bushing 30, a holder 40, an indentation 42, a sliding cam 50, a coupling portion 52 of the sliding cam, a fixed cam 60, a compression spring 70, a housing 80, a hinge assembly 100, and a damper 200.

The second disclosed embodiment of the invention also provides a hinge assembly 100 and a mobile terminal equipped with the hinge assembly. Here, the hinge assembly 100 can include a torsion spring 10, which may provide the force for unfolding the folder type mobile terminal; a shaft 20, which may penetrate the internal space of the torsion spring; a bushing 30, which may be coupled to one end 12 of the torsion spring and one side 22 of the shaft; a holder 40, which may be coupled to the other end 14 of the torsion spring, and through which the shaft may penetrate; a sliding cam 50, which may be coupled to the other side 24 of the shaft to move in linkage with the shaft; a fixed cam 60, which may face and touch the sliding cam; a compression spring 70, which may be interposed between the holder and the sliding cam; a housing 80, which may be coupled to the holder and the fixed cam; and a damper 200, which may dampen the rotation speed of the shaft.

According to this embodiment, the hinge assembly 100 can be interposed between a base unit 1 and a folder unit 2 of a mobile terminal to rotatably couple the base unit 1 with the folder unit 2, as illustrated FIG. 4. The torsion spring 10 of the hinge assembly may provide an elastic rotation force that can be used to unfold the folder type mobile terminal from a folded state.

The principle by which the torsion spring 10 unfolds the mobile terminal in the second disclosed embodiment of the invention is substantially the same as or similar to the principle employed in the first disclosed embodiment described above.

When the base unit 1 and the folder unit 2 are in a folded state, the torsion spring 10 may retain elastic torsion energy, which may be used to unfold the mobile terminal. A mobile terminal having a hinge assembly 100 according to the second disclosed embodiment of the invention may be kept folded by a magnetic attaching member or detent member that applies a force greater than the elastic force of the torsion spring. Then, when the force of the magnetic attaching member or detent member keeping the base unit 1 and the folder unit 2 folded is removed, the mobile terminal may be automatically unfolded by the torsion spring.

That is, in a mobile terminal equipped with a hinge assembly 100 according to the second disclosed embodiment of the invention, the base unit and folder unit may, from a folded state, be automatically unfolded by the elastic force of the torsion spring 10.

The torsion spring 10 can have a helical shape, as illustrated in FIGS. 5 and 6, and can be an elastic member that asserts a restoring force against twisting. The hinge assembly 100 may provide rotation in a particular direction using the elastic restoring force of the torsion spring, at which the base unit 1 and the folder unit 2 of the mobile terminal coupled by the hinge assembly may be automatically unfolded from a folded state.

The shaft 20 can penetrate through the torsion spring 10, and one side of the shaft 20 can be coupled to the bushing 30 such that the shaft 20 may move in linkage with the bushing 30. The shaft may correspond to the axis about which the hinge assembly 100 provides rotation. The shaft penetrating the torsion spring can also penetrate the holder 40 and can be coupled with the sliding cam 50 and the bushing 30 such that the shaft may move in linkage with the sliding cam 50 and the busing 30.

One end 12 of the torsion spring 10 can be coupled to the bushing 30, which may be coupled to one side 22 of the shaft 20. That is, with one end of the torsion spring coupled to the bushing, the torsion spring can provide a torsional elastic force to the bushing and the shaft. As the torsion spring, which may have one end coupled to and supported by the bushing, is twisted beyond its basic shape, the torsion spring may provide a torsional elastic force (torque).

Also, one side 22 of the shaft can be coupled to the bushing 30. According to this particular embodiment, the shaft 20 and the bushing can be coupled to each other for linked movement.

The shaft 20 can also penetrate the holder 40, and the other end 14 of the torsion spring 10 can be coupled to the shaft 20. Although the shaft may penetrate the holder, it may not move in linkage with the holder. That is, due to the torsion spring that has one end coupled to the bushing 30 and the other end coupled to the holder 40, the bushing and the shaft can be made to rotate in relative movement to the holder.

The sliding cam 50 can be coupled to the other side 24 of the shaft penetrating the holder 40. The sliding cam 50 can be coupled to the other side of the shaft, in order that the sliding cam may rotate in linkage with the shaft 20. On the sliding cam, there may be a coupling portion formed, to which the other side of the shaft can be coupled. The other side 24 of the shaft that is inserted through the coupling portion 52 of the sliding cam can have a cross section shaped as a D-cut, while the cross section of the coupling portion 52 of the sliding cam can be shaped in a D-cut in correspondence with the cross section of the other side 24 of the shaft. In this way, the sliding cam 50 and the shaft 20 can be made to move in linkage.

The fixed cam 60 can be positioned facing and touching the sliding cam 50. That is, the fixed cam can engage the sliding cam. The fixed cam can be placed in close contact with the sliding cam, which may move in linkage with the shaft 20. Thus, as described later in more detail, the fixed cam may control the rotation speed of the sliding cam and may thereby dampen the rotation of the shaft and the bushing.

The compression spring 70 can be positioned between the holder 40 and the sliding cam 50. An indentation 42 can be formed in the holder in which a portion of the compression spring may be inserted, so that the compression spring may be supported by the indentation of the holder to elastically push the sliding cam. In this way, the sliding cam can be placed in close contact with the fixed cam 60. As the sliding cam is put in close contact with the fixed cam, the sliding cam and the fixed cam may engage each other with greater reliability.

The housing 80 can be coupled with the fixed cam 60, the holder 40, and the case 210 of the damper 200, which may not move in linkage with the shaft 20. The housing can secure the fixed cam 60, the holder, and the damper 200 inside, and can hold the sliding cam 50, shaft 20, compression spring 70, and torsion spring 10. In other words, according to this embodiment, the housing may cover the torsion spring, shaft, holder, sliding cam, fixed cam, compression spring 70, and damper. That is, the fixed cam, holder, and damper may be covered secured to the housing 80, while the sliding cam, shaft, and torsion spring may be covered inside the housing in a manner that allows rotation.

According to this particular embodiment, the bushing 30 coupled to the one side 22 of the shaft may be exposed outside the housing 80.

The hinge assembly 100 according to this embodiment can be structured such that the sliding cam 50, shaft, and bushing 30 may be rotated by the elastic force of the torsion spring 10 in an opposite direction to the housing 80, fixed cam 60, and holder 40.

As set forth above, a hinge assembly 100 according to the second disclosed embodiment of the invention can be employed in coupling the base unit 1 and the folder unit 2 of a mobile terminal, to provide a mobile terminal that can be automatically unfolded without using a motor.

As illustrated in FIG. 4, a hinge 100 structure according to the second disclosed embodiment of the invention can be applied to a mobile terminal that includes a base unit 1, which may contain a board mounted with various electronic components, and which may include a keypad, etc.; a folder unit 2, which may be coupled to the base unit 1 in a manner that allows folding, and which may be unfolded by rotation; and a hinge assembly, which may be interposed between the base unit 1 and the folder unit 2 to rotatably couple the base unit 1 and folder unit 2 to each other.

A mobile terminal apparatus equipped with a hinge assembly 100 according to the second disclosed embodiment of the invention may thus be automatically unfolded without using a motor that requires electrical energy. Moreover, the hinge assembly based on this embodiment may provide a longer life span than does a hinge structure that requires a motor.

When the mobile terminal is folded, the torsion spring 10 may be torsionally deformed and may retain a torsional elastic restoring force in a direction that unfolds the base unit 1 and folder unit 2 of the mobile terminal. As the force of the magnetic attaching member or detent member keeping the base unit 1 and the folder unit 2 folded is removed, the bushing 30 and the housing 80 of the hinge assembly may rotate in opposite directions. In this way, the base unit 1 and the folder unit 2 each coupled to one and the other of the bushing and the housing may be unfolded.

According to this embodiment, the sliding cam 50, shaft 20, and bushing 30 can be rotated by the torsional elastic force of the torsion spring 10 in an opposite direction to the holder 40, fixed cam 60, and housing 80. Therefore, with the base unit 1 coupled to the housing, for example, and the folder unit 2 coupled to the bushing, the mobile terminal may be automatically unfolded. In other words, the base unit 1 and the folder unit 2 can be coupled to elements of the hinge assembly 100 that are rotated by the torsion spring 10 in different directions, to rotate together with the rotation of the hinge assembly.

According to the internal structure by which the base unit 1 and the folder unit 2 are coupled, the base unit 1 may be coupled to the bushing 30, and the folder unit 2 may be coupled to the housing 80.

The fixed cam 60, which may be coupled to the housing, can engage the sliding cam 50, which may be in linkage with the shaft 20. A tapering protrusion can be formed on the sliding cam, while a tapering depression can be formed in the fixed cam, so that the sliding cam may mate with the fixed cam. The shapes of the sliding cam and fixed cam described above may vary according to the demands of the user. With the fixed cam facing and maintaining contact with the sliding cam, which may undergo a relative rotating motion, the fixed cam may provide a damping force to the rotation of the sliding cam. The amount of damping force applied to the rotating motion of the hinge assembly can be adjusted according to the shape and structure of the interlocking fixed cam and sliding cam.

The fixed cam 60 and the sliding cam 50 may dampen the rotating speed of the elements of the hinge assembly 100. The rotation speed of the bushing 30 relative to the housing 80 may reach its maximum when the restoring force of the torsion spring 10 becomes 0, but this rotating speed can be dampened by the damping function provided by the sliding cam engaging the fixed cam.

The sliding cam 50, the shaft 20 moving in linkage with the sliding cam, and the bushing 30 coupled to the shaft can be rotated by the torsion spring 10 relative to the housing 80, where the rotation speed can be dampened by the fixed cam 60.

According to the second disclosed embodiment of the invention, when the restoring force of the torsion spring 10 unfolds the base unit and the folder unit, which may each be coupled to one and the other of the bushing 30 and the housing 80, the damping function of the fixed cam 60 and the sliding cam 50 may be implemented. Therefore, the mobile terminal can be unfolded smoothly, without receiving an impact at the maximum unfolding position.

In order to smoothly adjust the speed by which the mobile terminal may be unfolded, a reliable mating may be provided between the fixed cam 60 and the sliding cam 50. According to an embodiment of the invention, the compression spring 70 interposed between the holder 40 and the sliding cam can be supported by the holder to continuously apply an elastic force onto the sliding cam. Thus, the sliding cam can be placed in close contact with the fixed cam 60 by the compression spring continuously, to thereby implement the hinge assembly 100 with a reliable damping function.

A hinge assembly 100 based on this embodiment can thus be utilized to automatically unfold a motor terminal, without using a motor that requires electrical energy consumption, and to implement a smooth unfolding motion for the mobile terminal.

Also, according to this embodiment, a damper 200 can be coupled to the shaft, as illustrated in FIGS. 5 and 6, to dampen the rotation speed of the shaft and provide a smoother unfolding motion for the mobile terminal. In this particular embodiment, the other side of the shaft can penetrate through the sliding cam and the fixed cam to be coupled with the damper.

Figure 7:
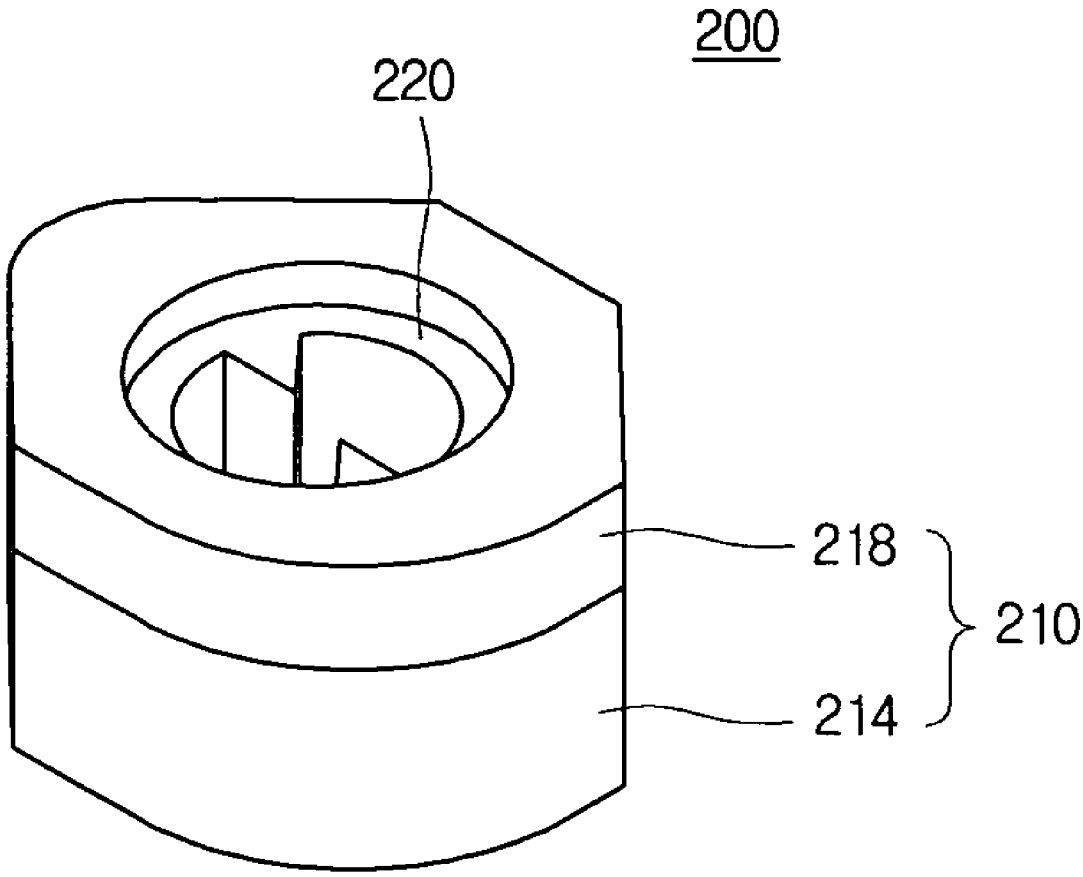
FIG. 7 is a perspective view of a damper in a hinge assembly according to the second disclosed embodiment of the invention.
Figure 8:
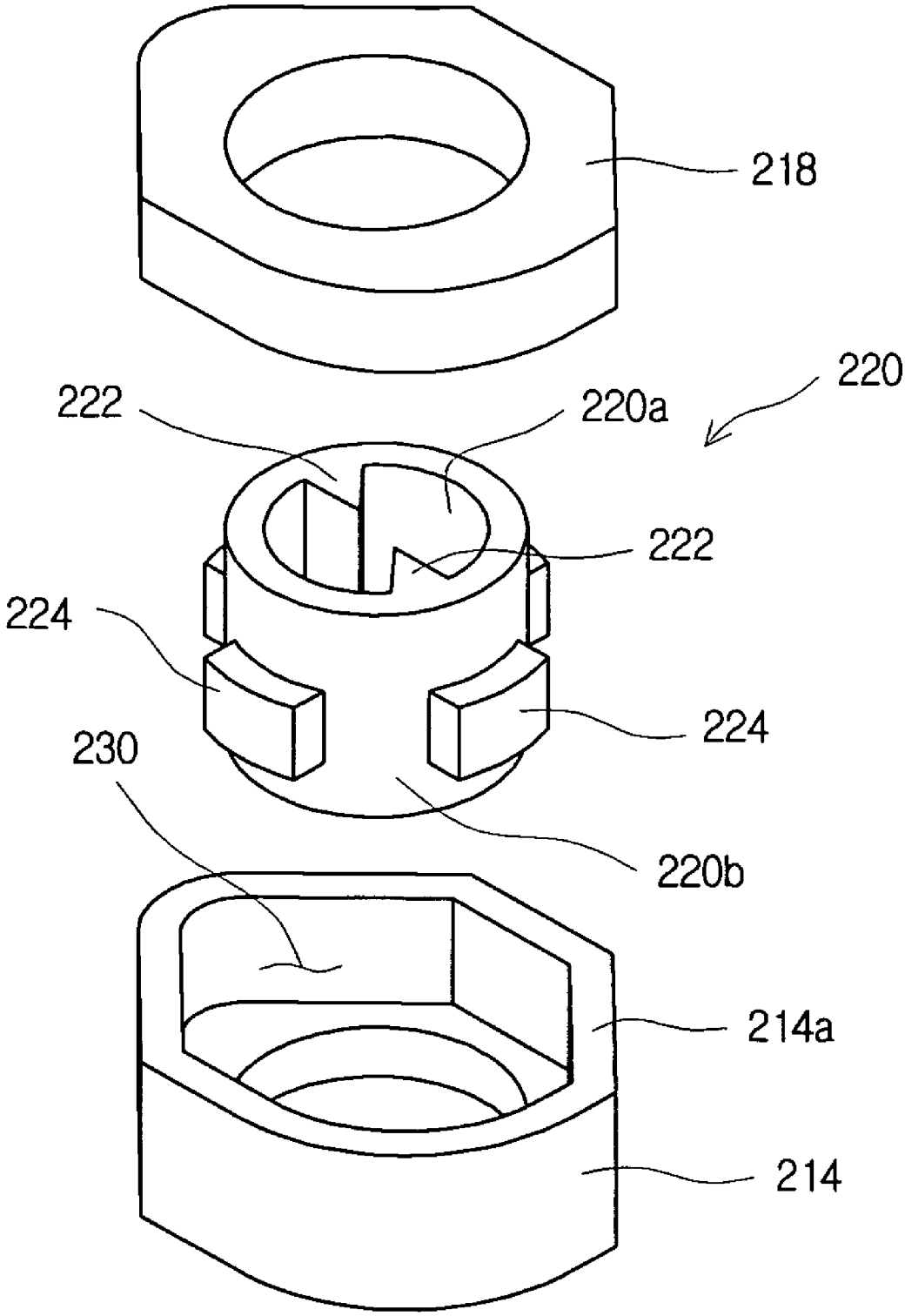
FIG. 8 is an exploded perspective view of a damper in a hinge assembly according to the second disclosed embodiment of the invention.

FIG. 7 is a perspective view of a damper in a hinge assembly according to the second disclosed embodiment of the invention, and FIG. 8 is an exploded perspective view of a damper in a hinge assembly according to the second disclosed embodiment of the invention.

As illustrated in FIGS. 7 and 8, the damper 200 in a hinge assembly based on the second disclosed embodiment of the invention can include a case 210 and a core 220 rotatably coupled inside the case. The case 210 can be secured coupled to the housing, and the shaft can be inserted inside the case to be coupled with the core 220. The core rotatably coupled inside the case 210 can be coupled to the shaft to move in linkage with the shaft. That is, the core 220 can move in linkage with the shaft and can rotate relative to the case, which may be coupled to the housing.

A viscous fluid can be filled in between the case 210 and the core 220 that applies friction to the relative motion of the core. The viscous fluid can be injected between the case and the core and sealed. The viscous fluid can be a fluid that has a high level of viscosity, capable of decelerating the rotation speed of the shaft by applying friction to the rotation of the core. As such, a high-viscosity grease or silicone oil can be used for the viscous fluid.

According to this embodiment, the cross section at the end portion of the other side of the shaft that penetrates the sliding cam and the fixed cam can be shaped as a rectangle or a symmetrical D-cut form. As illustrated in FIG. 6, the end portion of the shaft's other side that may be coupled with the damper 200 can have a shape similar to that obtained when the portions of the cylindrical shaft are cut off from the sides symmetrically.

As shown in FIG. 8, the core 220 can be shaped as a hollow tube, so that the shaft can be inserted into the core 220, while detent protrusions 222 can be formed symmetrically on the inner wall 220*a* of the core. The shaft, having the shape described above, can be inserted in the core in which the detent protrusions are formed. When the shaft having a rectangular or a D-cut shape is rotated, the shaft may come into contact with the detent protrusions 222 of the core at a particular angle. Thus, starting from the angle at which the shaft comes into contact with the detent protrusions, the core may move in linkage with the shaft. Because of the detent protrusions formed symmetrically on the inner wall 220*a* of the core, the core may move in linkage with the shaft at certain angles, from among the range of possible rotation angles of the shaft. Also, when the shaft is rotated in the opposite direction, the shaft may not move in linkage with the core until the shaft reaches those certain angles.

During the time the core 220 moves in linkage with the shaft, the core may receive the friction of the viscous fluid, whereby the rotation speed of the shaft may be dampened. That is, from among the rotation angles of the shaft, the shaft can move in linkage with the core at certain angles, at which the shaft is placed in contact with the detent protrusion 222, and the rotating speed can be dampened.

According to this embodiment, the cross section at the end portion of the other side of the shaft that penetrates the sliding cam and the fixed cam can be shaped as a rectangle or a symmetrical D-cut form. As illustrated in FIG. 6, the end portion of the other side of the shaft that may be coupled with the core 220 of the damper 200 can have a shape similar to that obtained when the portions of the cylindrical shaft are cut off from the sides symmetrically.

Here, the end portion of the other side of the shaft can be made to contact the detent protrusions 222, and the range in which the shaft may move in contact with the core 220 can be adjusted by changing the positions and shapes of the detent protrusions. That is, looking at the cross section of the core 220, altering the angle from one detent protrusion 222 to the other detent protrusion, with respect to the center of the circular cross section of the core, can be used to adjust the range in which there is linked movement. The smaller the angle from one detent protrusion to the other detent protrusion, the greater the range of angles at which the core may move in linkage with the shaft.

By this principle described above, the effect of the damper 200 can be applied to dampen the speed of the shaft at certain angles, from among the range of possible rotation angles.

The higher the viscosity of the viscous fluid, or the greater the friction between the viscous fluid and the core 220, the greater may be the damping effect of the damper 200. As illustrated in FIG. 8, a blade 224 can be formed along the perimeter 220*b* of the core, in order to increase the friction between the viscous fluid and the core 220. The blade 224 can be formed on the core perimeter, which contacts the viscous fluid, in a position facing the case 210. As the blade can be used to increase the friction to the viscous fluid, a number of blades can be employed.

Also, according to this embodiment, the case 210 can be made of a case body 214, in which the core 220 and the viscous fluid can be held, and a case lid 218, which can cover the core and the case body such that the viscous fluid is sealed. The core can be held in the internal space 230 formed by the case body and the case lid, and the viscous fluid can be injected into the internal space 230.

While an example has been provided in which the case 210 may be composed of a case body and a case lid, it is to be appreciated that any composition for the case that is capable of holding the core and the viscous fluid is encompassed by the spirit of the present invention.

As in the example shown in FIG. 8, a hole can be formed in the case lid 218 through which the shaft may be inserted. The shaft may pass through the hole, to be connected with the core 220 held inside the case. A hole can also be formed in the case body 214, so that the shaft may be coupled to the damper penetrating the damper 200.

As in the example shown in FIGS. 7 and 8, the case lid 218 can surround the perimeter of the one side of the core in close contact, so that the viscous fluid may be sealed. The case lid and the perimeter of the one side of the core can be placed in close contact but in a manner that allows slipping. Also, the case lid can be placed in close contact with one surface of the case body 214, whereby the viscous fluid may be sealed within the case 210. A ring of silicone can be placed between the case lid and the case body to prevent the viscous fluid from leaking.

Figure 9:
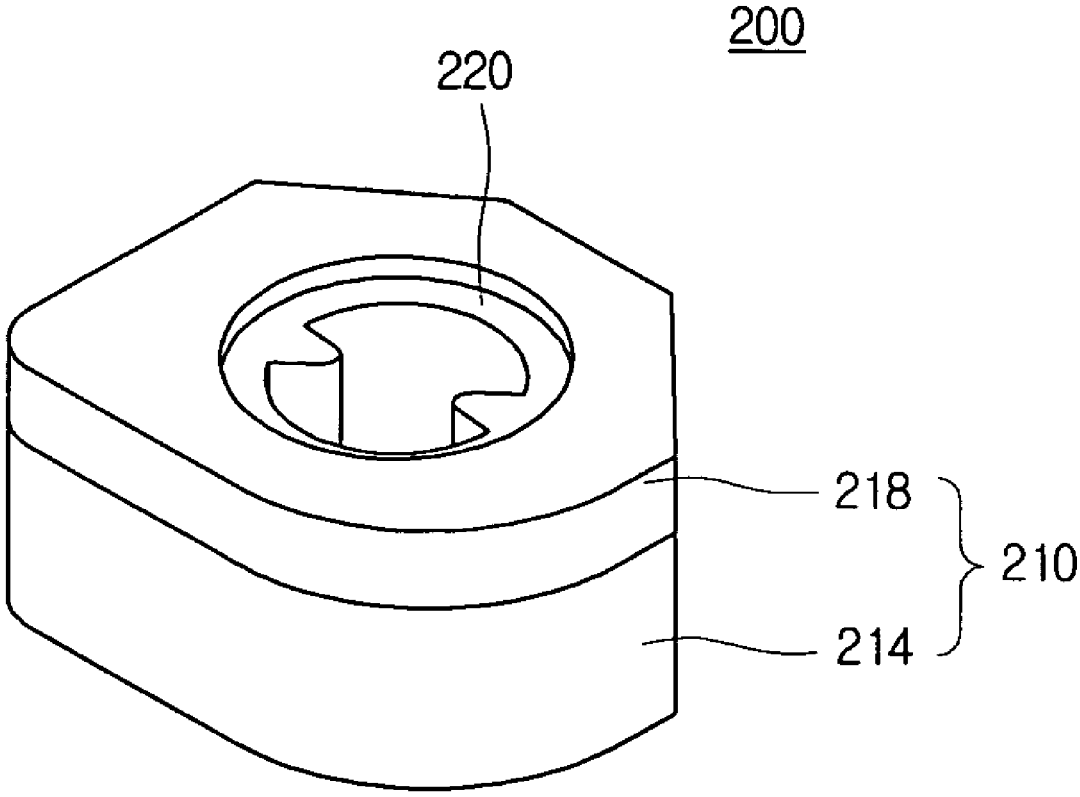
FIG. 9 is a perspective view of a damper in a hinge assembly according to a third disclosed embodiment of the invention.
Figure 10:
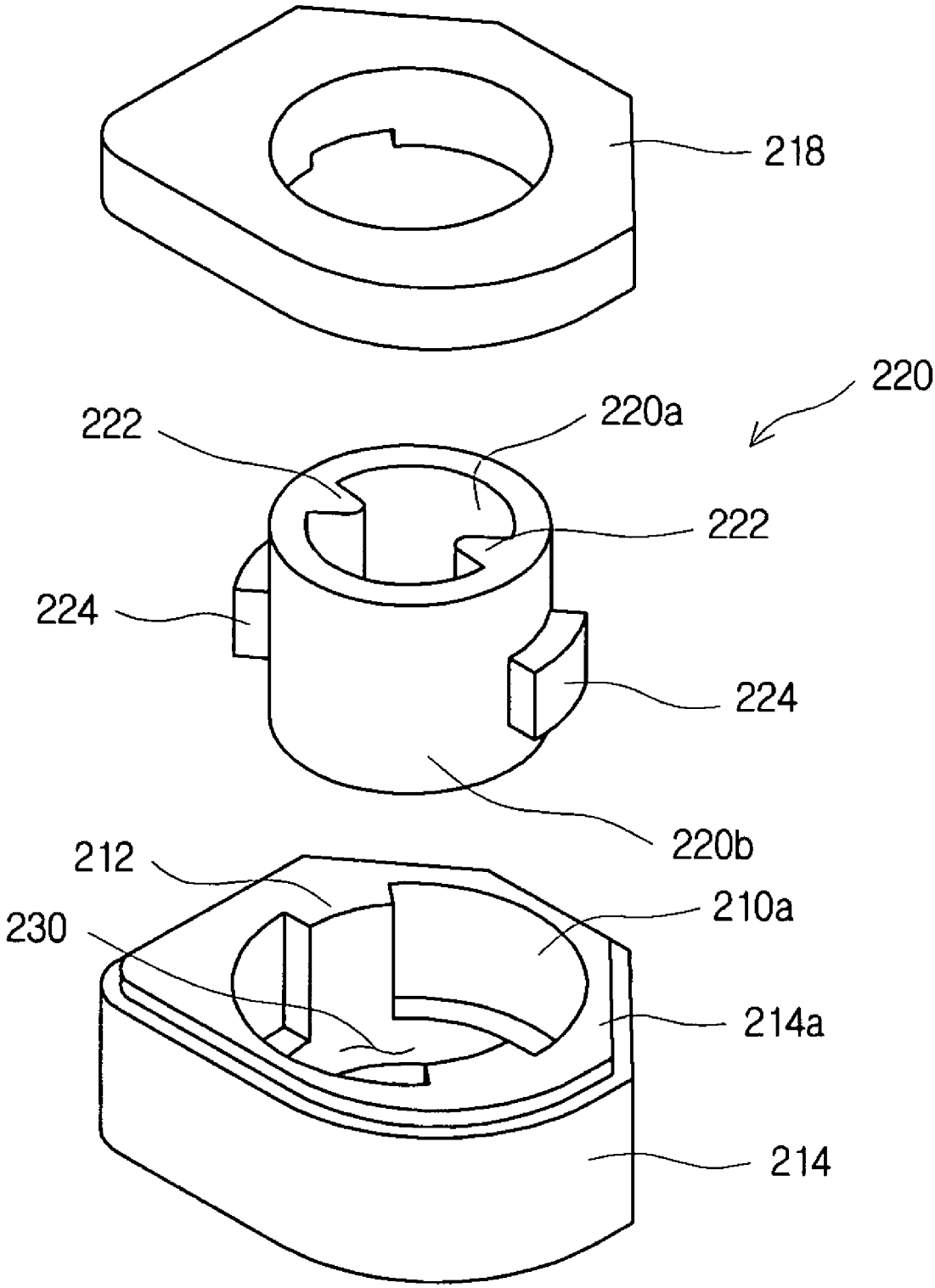
FIG. 10 is an exploded perspective view of a damper in a hinge assembly according to the third disclosed embodiment of the invention.

A description will now be provided, with reference to FIG. 9 and FIG. 10, for the damper of a hinge assembly according to a third disclosed embodiment of the invention. The structure of the hinge assembly, other than the internal structure of the damper, and the manner in which the hinge assembly is coupled to the mobile terminal may be substantially the same as those for the second disclosed embodiment of the invention presented above.

FIG. 9 is a perspective view of a damper in a hinge assembly according to the third disclosed embodiment of the invention, and FIG. 10 is an exploded perspective view of a damper in a hinge assembly according to the third disclosed embodiment of the invention.

According to the third disclosed embodiment of the invention, a hinge assembly is disclosed, which can be equipped with a damper 200 that may include a case lid 218, core 220, and case body 214, similar to the second disclosed embodiment described above. The structures and functions of the case lid and the core may be substantially the same as those for the second disclosed embodiment.

In this embodiment, protruding portions 212 can be formed on the case inner wall 210*a*, i.e. the inner wall of the case body. The protruding portions 212 may provide friction to the core blades 224, to inhibit the flow of the viscous fluid. As the flow of the viscous fluid is blocked by the protruding portions, the core 220 may not easily rotate. In this way, the damping force of the damper 200 can be increased.

The coupling structures for the case body 214, core 220, and case lid 218 may be substantially the same as those for the second disclosed embodiment.

Figure 11:
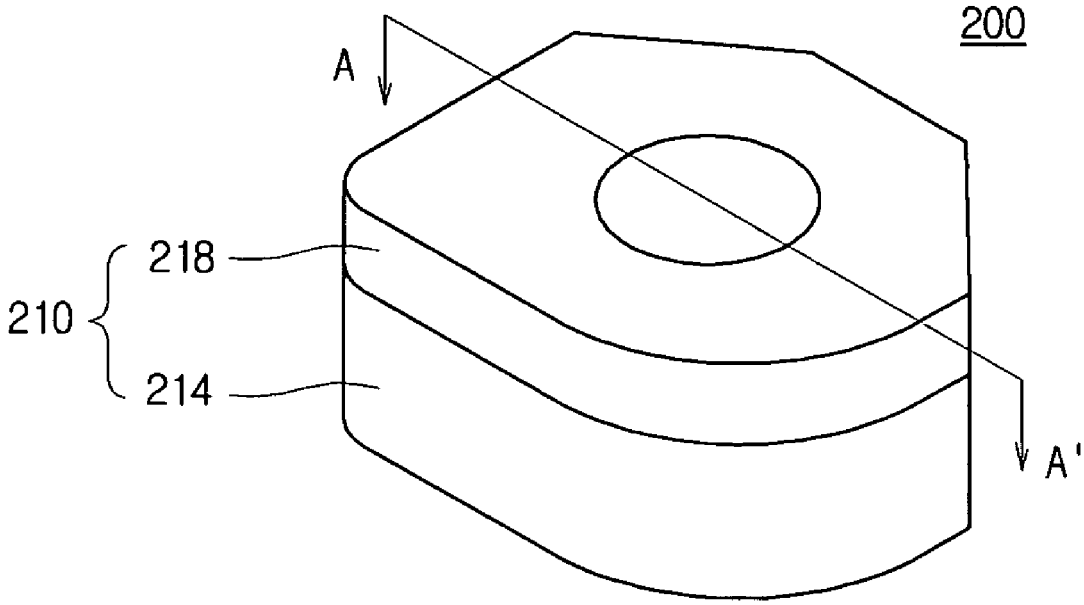
FIG. 11 is a perspective view of a damper in a hinge assembly according to a fourth disclosed embodiment of the invention.
Figure 12:
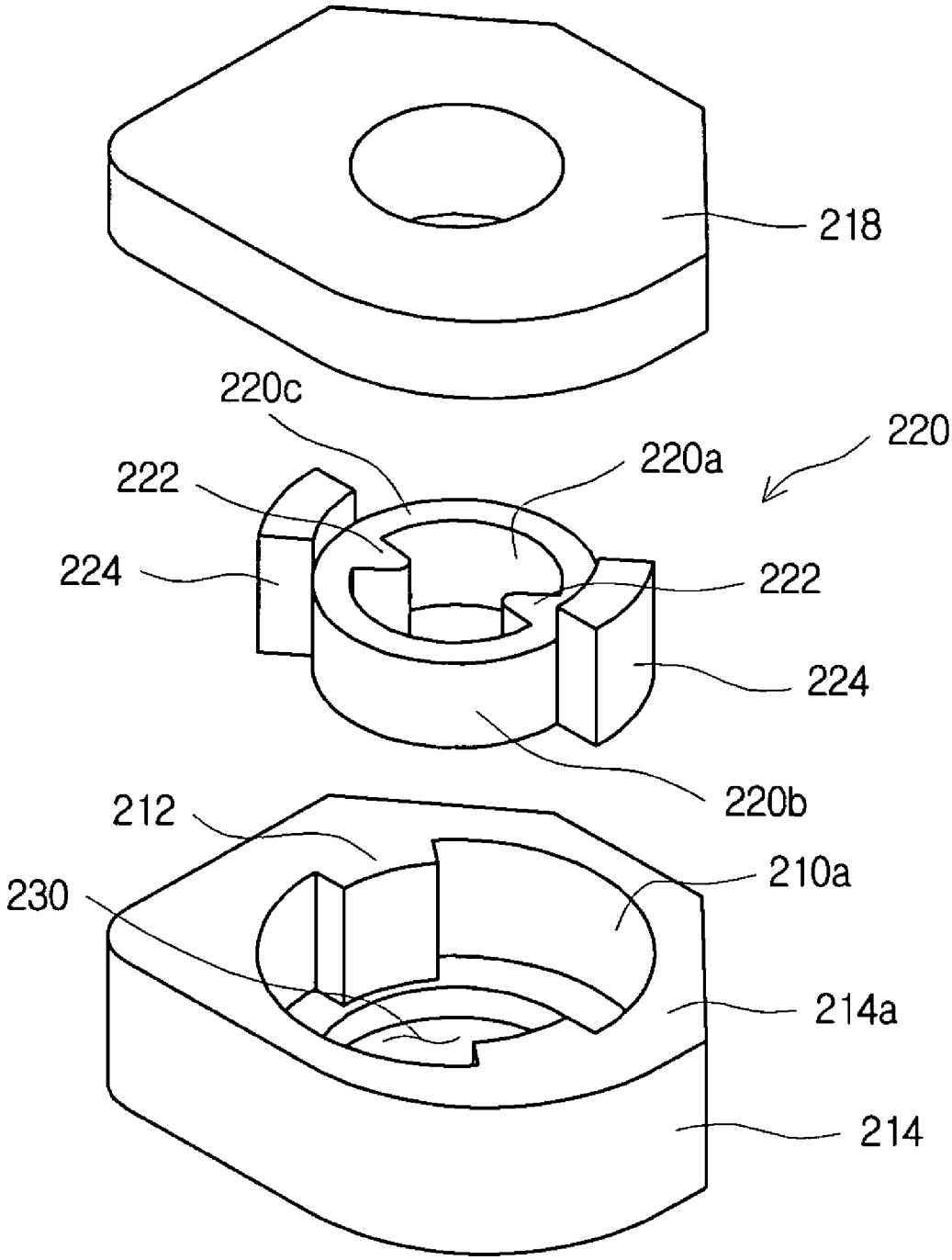
FIG. 12 is an exploded perspective view of a damper in a hinge assembly according to the fourth disclosed embodiment of the invention.
Figure 13:
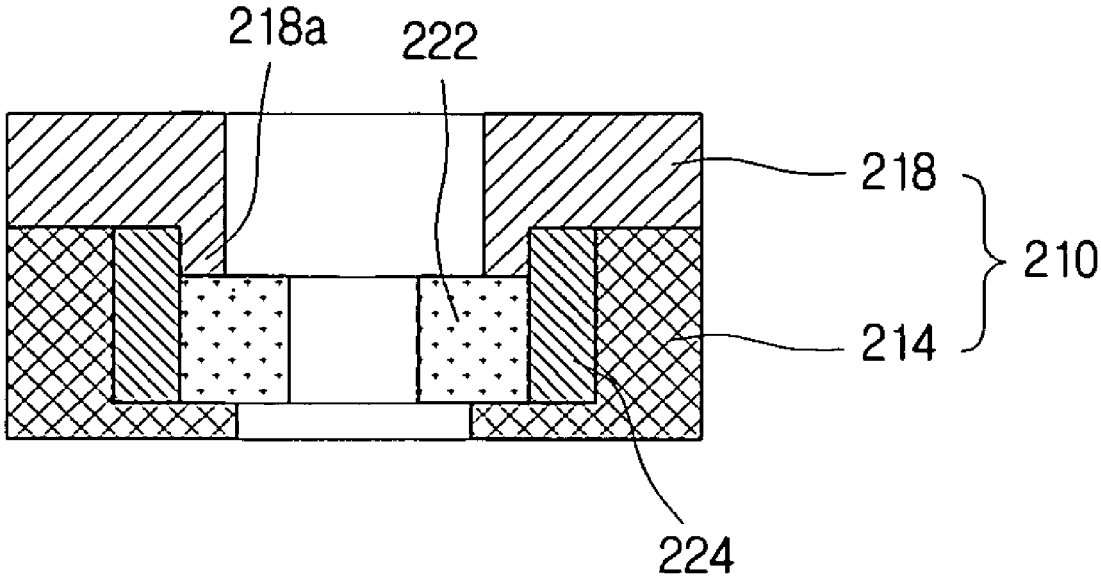
FIG. 13 is a cross sectional view across line A-A' in FIG. 11.

A description will now be provided, with reference to FIG. 11 through FIG. 13, for the damper 200 of a hinge assembly according to a fourth disclosed embodiment of the invention. The structure of the hinge assembly, other than the internal structure of the damper, and the manner in which the hinge assembly is coupled to the mobile terminal may be substantially the same as those for the second disclosed embodiment of the invention presented above.

FIG. 11 is a perspective view of a damper in a hinge assembly according to the fourth disclosed embodiment of the invention, and FIG. 12 is an exploded perspective view of a damper in a hinge assembly according to the fourth disclosed embodiment of the invention. FIG. 13 is a cross sectional view across line A-A' in FIG. 11.

According to the fourth disclosed embodiment of the invention, a hinge assembly is disclosed, which can be equipped with a damper 200 that may include a case lid 218, core 220, and case body 214. The structure and function of the case body 214 may be substantially the same as those for the third disclosed embodiment described above.

In this embodiment, the thickness of the core can be lower than the height of the blades 224. As illustrated in FIG. 12, one surface 220*c* of the core can be formed lower than the blades. The core can be formed to a particular thickness that allows the core to be coupled to the shaft for linked movement, while the blades that cause friction with the viscous fluid can be formed higher than the surface 220*c* of the core.

Also, a curb 218*a* protruding towards the core 220 can be formed on the case lid 218, as illustrated in FIG. 13. The curb 218*a* can be formed to a height that allows close contact with the one surface 220*c* of the core. Thus, according to this embodiment, the curb can be formed on the case lid in correspondence with the lower thickness of the core, so that the curb may be placed in close contact with the surface 220*c* of the core, sealing the viscous fluid between the case and the core. The curb and the core can maintain close contact in a manner that allows slipping.

As described above, the case lid 218, on which the curb 218*a* may be formed, can be applied in close contact with one surface 214*a* of the case body. In this way, the viscous fluid can be sealed inside the case.

Also, as described above, protruding portions 212 can be formed on the inner wall of the case body 214, where the protruding portions may increase the damping force of the damper 200.

To recapitulate, the shaft can be coupled to the damper 200, and the damper can dampen the rotating speed of the shaft at certain angles at which the shaft may be rotating. Thus, in a mobile terminal equipped with a hinge assembly based on the second to fourth disclosed embodiments of the invention, the folder unit can be unfolded smoothly, without having the elastic energy cause an impact at the maximum unfolding angle.

According to certain embodiments of the invention as set forth above, by utilizing a torsion spring in the hinge assembly structure, a mobile terminal can be made to unfold automatically in a smooth movement using just a few number of parts.

While the spirit of the invention has been described in detail with reference to particular embodiments, the embodiments are for illustrative purposes only and do not limit the invention. It is to be appreciated that those skilled in the art can change or modify the embodiments without departing from the scope and spirit of the invention.

Many embodiments other than those set forth above can be found in the appended claims.

What is claimed is:

1. A hinge assembly comprising:
- a torsion spring;
- a shaft penetrating through the torsion spring;
- a bushing coupled to one end of the torsion spring and coupled to one end of the shaft;
- a holder coupled to the other end of the torsion spring and having the shaft penetrating therethrough;
- a sliding cam coupled to the other end of the shaft and configured to move in linkage with the shaft;
- a fixed cam engaging the sliding cam;
- a compression spring interposed between the holder and the sliding cam and configured to place the sliding cam in close contact with the fixed cam; and
- a housing coupled to the holder and the fixed cam.

2. The hinge assembly of claim 1, wherein the other end of the shaft has a D-cut shaped cross section, and
- the sliding cam has a cross section at a coupling portion thereof shaped in correspondence with the cross section of the other end of the shaft.

3. The hinge assembly of claim 1, wherein the holder has an indentation formed therein, the compression spring inserted in the indentation, and
- the compression spring is supported by the indentation so as to elastically press the sliding cam such that the sliding cam is placed in close contact with the fixed cam.

4. The hinge assembly of claim 1, wherein the housing is configured to cover the torsion spring, the shaft, the holder, the sliding cam, the fixed cam, and the compression spring.

5. A mobile terminal comprising:
- a base unit;
- a folder unit rotatably coupled to the base unit; and
- a hinge assembly interposed between the base unit and the folder unit and configured to rotatably couple the base unit and the folder unit, wherein the hinge assembly comprises:
  - a torsion spring;
  - a shaft penetrating through the torsion spring;
  - a bushing coupled to one end of the torsion spring and coupled to one end of the shaft;
  - a holder coupled to the other end of the torsion spring and having the shaft penetrating therethrough;
  - a sliding cam coupled to the other end of the shaft and configured to move in linkage with the shaft;
  - a fixed cam engaging the sliding cam;
  - a compression spring interposed between the holder and the sliding cam and configured to place the sliding cam in close contact with the fixed cam; and
  - a housing coupled to the holder and the fixed cam.

6. The mobile terminal of claim 5, wherein the other end of the shaft has a D-cut shaped cross section, and
- the sliding cam has a cross section at a coupling portion thereof shaped in correspondence with the cross section of the other end of the shaft.

7. The mobile terminal of claim 5, wherein the holder has an indentation formed therein, the compression spring inserted in the indentation, and
- the compression spring is supported by the indentation so as to elastically press the sliding cam such that the sliding cam is placed in close contact with the fixed cam.

8. The mobile terminal of claim 5, wherein the housing is configured to cover the torsion spring, the shaft, the holder, the sliding cam, the fixed cam, and the compression spring.

9. The mobile terminal of claim 5, wherein the base unit is coupled to one of the housing and the bushing, and
- the folder unit is coupled to the other of the housing and the bushing.

10. A hinge assembly comprising:
- a torsion spring;
- a shaft penetrating through the torsion spring;
- a bushing coupled to one end of the torsion spring and coupled to one end of the shaft;
- a holder coupled to the other end of the torsion spring and having the shaft penetrating therethrough;
- a sliding cam coupled to the other end of the shaft and configured to move in linkage with the shaft;
- a fixed cam engaging the sliding cam;
- a compression spring interposed between the holder and the sliding cam and configured to place the sliding cam in close contact with the fixed cam;
- a housing coupled to the holder and the fixed cam; and
- a damper coupled to the shaft and configured to dampen a rotation speed of the shaft.

11. The hinge assembly of claim 10, wherein the damper is configured to dampen the rotation speed of the shaft at certain angles from among possible rotation angles of the shaft.

12. The hinge assembly of claim 10, wherein the damper comprises:

a case coupled to the housing and having the shaft inserted therethrough;

a core rotatably held inside the case and configured to move in linkage with the shaft; and a viscous fluid interposed between the case and the core.

13. The hinge assembly of claim 12, wherein the core is configured to move in linkage with the shaft at certain angles from among possible rotation angles of the shaft.

14. The hinge assembly of claim 12, wherein the core is shaped as a hollow tube such that the shaft is inserted and rotated in the core, and the core comprises a detent protrusion formed on an inner wall thereof such that the core moves in linkage with the shaft at certain angles from among possible rotation angles of the shaft.

15. The hinge assembly of claim 12, wherein the core comprises a blade formed on a perimeter thereof, the blade configured to apply friction with respect to the viscous fluid.

16. The hinge assembly of claim 12, wherein the case comprises a protruding portion formed on an inner wall thereof.

17. The hinge assembly of claim 12, wherein the case comprises:

a case body holding the core and the viscous fluid; and a case lid having the shaft penetrating therethrough and configured to cover the core and the case such that the viscous fluid is sealed.

18. The hinge assembly of claim 17, wherein the case lid is in close contact with one surface of the core and one surface of the case body.

19. The hinge assembly of claim 17, wherein the case lid surrounds a perimeter of one side of the core in close contact, and the case lid is in close contact with one surface of the case body.

20. The hinge assembly of claim 10, wherein the other end of the shaft has a D-cut shaped cross section, the sliding cam comprises a coupling portion, the coupling portion coupled to the other end of the shaft, and the sliding cam has a cross section at the coupling portion shaped in correspondence with the cross section of the other end of the shaft.

21. The hinge assembly of claim 10, wherein the holder has an indentation formed therein, the compression spring inserted in the indentation.

22. The hinge assembly of claim 10, wherein the housing is configured to cover the torsion spring, the shaft, the holder, the sliding cam, the fixed cam, the compression spring, and the damper.

23. A mobile terminal comprising:

a base unit;

a folder unit rotatably coupled to the base unit; and a hinge assembly interposed between the base unit and the folder unit and configured to rotatably couple the base unit and the folder unit, wherein the hinge assembly comprises:

a torsion spring;

a shaft penetrating through the torsion spring;

a bushing coupled to one end of the torsion spring and coupled to one end of the shaft;

a holder coupled to the other end of the torsion spring and having the shaft penetrating therethrough;

a sliding cam coupled to the other end of the shaft and configured to move in linkage with the shaft;

a fixed cam engaging the sliding cam;

a compression spring interposed between the holder and the sliding cam and configured to place the sliding cam in close contact with the fixed cam;

a housing coupled to the holder and the fixed cam; and a damper coupled to the shaft and configured to dampen a rotation speed of the shaft.

24. The mobile terminal of claim 23, wherein the damper is configured to dampen the rotation speed of the shaft at certain angles from among possible rotation angles of the shaft.

25. The mobile terminal of claim 23, wherein the damper comprises:

a case coupled to the housing and having the shaft inserted therethrough;

a core rotatably held inside the case and configured to move in linkage with the shaft; and a viscous fluid interposed between the case and the core.

26. The mobile terminal of claim 25, wherein the core is configured to move in linkage with the shaft at certain angles from among possible rotation angles of the shaft.

27. The mobile terminal of claim 25, wherein the core is shaped as a hollow tube such that the shaft is inserted and rotated in the core, and the core comprises a detent protrusion formed on an inner wall thereof such that the core moves in linkage with the shaft at certain angles from among possible rotation angles of the shaft.

28. The mobile terminal of claim 25, wherein the core comprises a blade formed on a perimeter thereof, the blade configured to apply friction with respect to the viscous fluid.

29. The mobile terminal of claim 25, wherein the case comprises a protruding portion formed on an inner wall thereof.

30. The mobile terminal of claim 25, wherein the case comprises:

a case body holding the core and the viscous fluid; and a case lid having the shaft penetrating therethrough and configured to cover the core and the case such that the viscous fluid is sealed.

31. The mobile terminal of claim 30, wherein the case lid is in close contact with one surface of the core and one surface of the case body.

32. The mobile terminal of claim 30, wherein the case lid surrounds a perimeter of one side of the core in close contact, and the case lid is in close contact with one surface of the case body.

33. The mobile terminal of claim 23, wherein the other end of the shaft has a D-cut shaped cross section, the sliding cam comprises a coupling portion, the coupling portion coupled to the other end of the shaft, and the sliding cam has a cross section at the coupling portion shaped in correspondence with the cross section of the other end of the shaft.

34. The mobile terminal of claim 23, wherein the holder has an indentation formed therein, the compression spring inserted in the indentation.

35. The mobile terminal of claim 23, wherein the housing is configured to cover the torsion spring, the shaft, the holder, the sliding cam, the fixed cam, the compression spring, and the damper.

36. The mobile terminal of claim 23, wherein the base unit is coupled to one of the housing and the bushing, and the folder unit is coupled to the other of the housing and the bushing.

* * * * *